US008344952B2

(12) United States Patent
Yi et al.

(10) Patent No.: US 8,344,952 B2
(45) Date of Patent: Jan. 1, 2013

(54) PORTABLE TERMINAL AND ANTENNA MODULE THEREOF FOR RECEIVING BROADCAST SIGNAL

(75) Inventors: Kyung-Hack Yi, Seoul (KR); Dong-Ho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 664 days.

(21) Appl. No.: 12/465,416

(22) Filed: May 13, 2009

(65) Prior Publication Data

US 2009/0284423 A1 Nov. 19, 2009

(30) Foreign Application Priority Data

May 14, 2008 (KR) ..... 10-2008-0044744

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

| | | | | |
|---|---|---|---|---|
| 4,356,492 | A | 10/1982 | Kaloi | |
| 6,642,892 | B2 * | 11/2003 | Masaki et al. | 343/702 |
| 7,148,851 | B2 * | 12/2006 | Takaki et al. | 343/702 |
| 7,199,759 | B2 * | 4/2007 | Noguchi et al. | 343/702 |
| 2005/0206574 | A1 | 9/2005 | Okayama | |

FOREIGN PATENT DOCUMENTS

| | | | |
|---|---|---|---|
| EP | 0 831 546 | A2 | 3/1998 |
| EP | 0 863 571 | A2 | 9/1998 |
| EP | 0 944 128 | A1 | 9/1999 |
| JP | 2000-232315 | A | 8/2000 |
| WO | WO-2005/081359 | A1 | 9/2005 |

* cited by examiner

*Primary Examiner* — Tan Ho

(74) *Attorney, Agent, or Firm* — Birch, Stewart, Kolasch & Birch, LLP

(57) ABSTRACT

A portable terminal with an antenna for receiving broadcast signals, includes an antenna module having a chip antenna patterned on a dielectric chip so as to define a physical length of the antenna module that enables the chip antenna to operate within a broadcast band, and a conductive plate connected to the chip antenna and having an area such that conductive plate leads a main radiation of the antenna module on the broadcast band, whereby the physical length of the antenna module can be reduced as short as possible by employing the chip antenna. Accordingly, the chip antenna facilitates making the antenna module and the portable terminal be smaller in size. Also, the chip antenna is configured to lead a main radiation on the conductive plate, thereby increasing radio reception quality and improving radio performance.

17 Claims, 7 Drawing Sheets

PORTABLE TERMINAL AND ANTENNA MODULE THEREOF FOR RECEIVING BROADCAST SIGNAL

RELATED APPLICATION

This application claims priority to Korean Patent Application No. 10-2008-0044744, filed on May 14, 2008 in the Republic of Korea, which is herein expressly incorporated by reference in its entirety.

BACKGROUND OF THE INVENTION

1. Field of the Invention

Embodiments of the present invention relate to a portable terminal with an antenna for receiving broadcast signals.

2. Background of the Invention

A portable terminal is a device that may be carried around and may perform one or more functions such as voice and telephony call communications, input and/or output of information, storing data and the like.

As such functions become more diversified, the portable terminal may support more complicated functions such as capturing still images or video, playing music or video files, playing games, receiving broadcast signals, and the like. By comprehensively and collectively implementing such functions, the portable terminal may be embodied as a multimedia player or device. In addition, efforts are ongoing to support and increase the functionality of portable terminals. Such efforts include software and hardware improvements. For example, a user interface environment is provided to allow users to easily and conveniently search for or select functions for the portable terminal.

As telecommunication fields have developed, an amount of data to be wirelessly communicated and a rate of transmission have drastically increased. To this end, an antenna is required to receive wireless (radio) data with higher reception quality during movement of the portable terminal.

Also, radio services which can be provided via the portable terminal have increased. Examples of such radio services include cellular mobile communications, digital broadcasting, short-range communications including BLUETOOTH, high-speed data communications, and the like.

An antenna installed in the portable terminal was originally developed to be mounted to be externally exposed, but the use of internal antennas has increased, consideration of the outward appearance of the externally exposed antenna in portable terminal has become an issue. However, configurations of internal antennas cause a problem in implementation of radio functionality. In particular, a broadcast band uses longer waves than a mobile communication band, which causes an antenna to have a relatively long physical length, whereby a degradation of reception quality may be caused when the antenna of a relatively short physical length is installed in the portable terminal.

An antenna used for receiving broadcasts may use a rod or wheel extended outwardly from a portable terminal or employ an earphone cable as a radiator. However, in this case, such an antenna may detrimentally affect an aesthetic of the outer appearance of the portable terminal and additionally be subjected to being damaged or lost. Furthermore, when the earphone cable is used as the antenna, users may find difficult to view (watch) or listen to broadcasts through a loud speaker disposed in the portable terminal having the loose earphone cables.

SUMMARY OF THE INVENTION

Therefore, an object of an embodiment of the present invention is to enhance an aesthetic effect of an outer appearance of a portable terminal by installing a broadcast receiving antenna inside the portable terminal having a spatial limitation.

To achieve these and other advantages and in accordance with this and other purposes of the present invention, as embodied and broadly described herein, there is provided a portable terminal including, a terminal case, and a antenna module installed in the terminal case, and configured to receive a broadcast band, wherein the antenna module includes a chip antenna having a dielectric chip and a conductor, the conductor being patterned on the dielectric chip so as to define a physical length of the chip antenna that enables the chip antenna to operate within the broadcast band, and a conductive plate connected to the chip antenna, and configured to have an area on which a main radiation of the antenna module occurs. A physical length of the broadcast receiving antenna can be reduced as short as possible by employing the chip antenna. Accordingly, the chip antenna facilitates making the antenna module and the portable terminal smaller in size. Also, the chip antenna is configured to lead a main radiation on the conductive plate, thereby increasing radio reception quality and improving radio performance.

In one embodiment of the present invention, the conductive plate may be integrally formed with the chip antenna to form one body. The conductive plate and the chip antenna may be fabricated by a single process, whereby the antenna module may be handled easily and assembly of the portable terminal is improved. The conductive plate may be configured in a form of a flexible plate such that the conductive plate can reduce or prevent an increase in a thickness of the antenna module, and allow the antenna module to be flexibly engaged with a particular space within the terminal case.

In one embodiment of the present invention, the conductive plate may have one of a meander line pattern, a spiral pattern, and a combined pattern of the meander line pattern and the spiral pattern.

In one embodiment of the present invention, the conductive plate may be plural in number, wherein the respective plurality of the conductive plates may be formed in different patterns.

In one embodiment of the present invention, the terminal case may have a side surface on an edge portion thereof, and the antenna may be disposed inside a recess in the side surface of the terminal case. Hence, the interference of the antenna module with other components within the terminal case can be minimized and radio reception quality can be improved.

In one embodiment of the present invention, the dielectric chip may have a relative permittivity equal to or greater than 1.0, and also have a relative permeability equal to or greater than 1.0. Accordingly, the dielectric chip with the permittivity and the permeability can effectively reduce the physical length of the antenna module.

In one embodiment of the present invention, the broadcast band may be implemented as a frequency modulation (FM) band or a terrestrial TV broadcast band.

In embodiment of the present invention, feeding portions of the antenna module may be disposed at the chip antenna. Here, the feeding portions may include a signal feeding portion connected to the conductor of the chip antenna, and a ground feeding portion connected to a ground of the portable terminal, and electromagnetically coupled to the conductor of the chip antenna.

In one embodiment of the present invention, an antenna module for receiving a broadcast band includes a chip antenna having a dielectric chip and a conductor, the conductor being formed over the dielectric chip and defining a length of the chip antenna to operate within the broadcast band; and a conductive plate connected to the chip antenna and positioned at a side thereof, and configured to have an area that induces a main radiation of the broadcast band.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate example embodiments of the present invention and together with the description serve to explain the principles and the various embodiments of the present invention.

In the drawings.

DETAILED DESCRIPTION OF THE INVENTION

Figure 1:
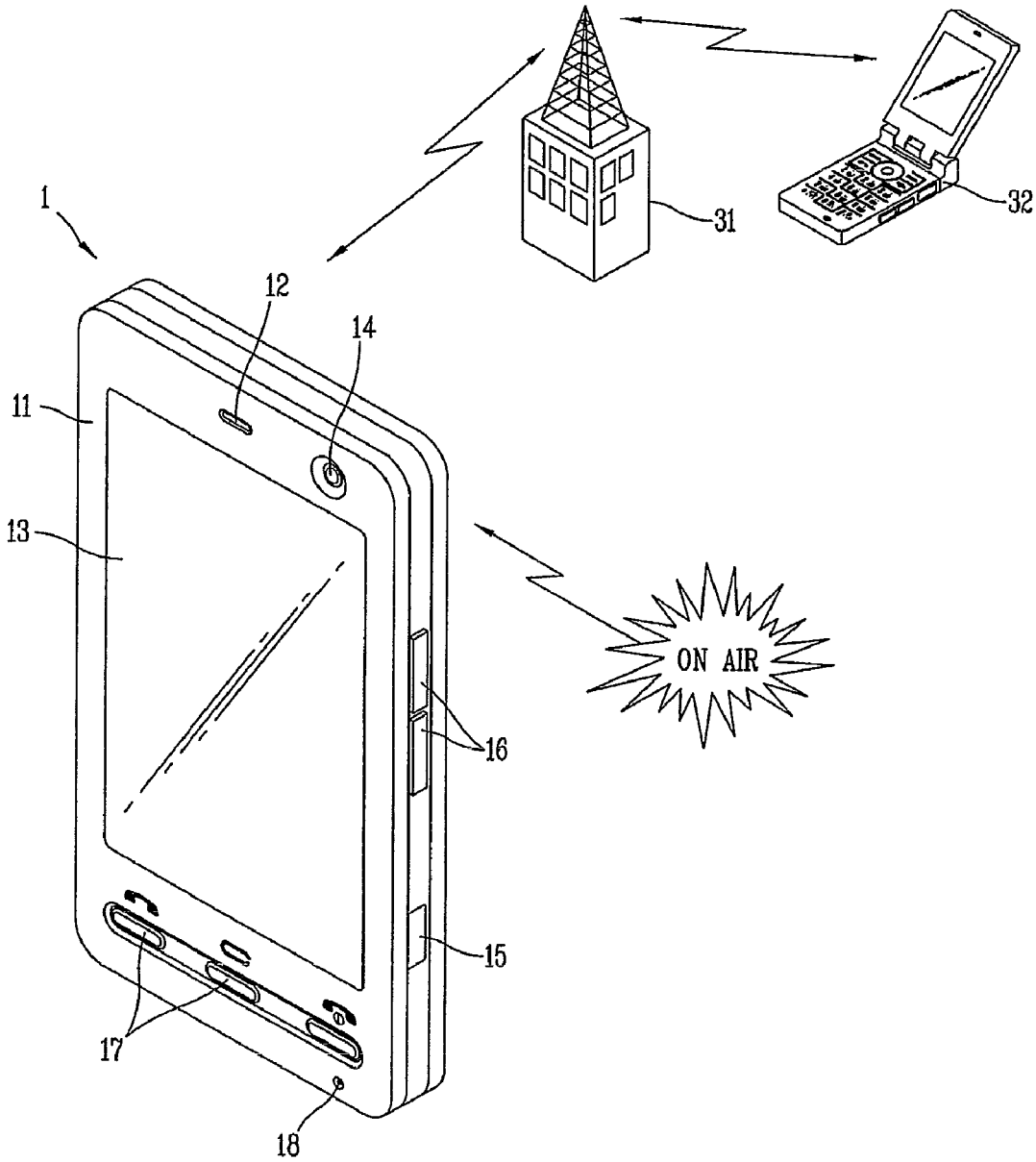
FIG. 1 is a schematic view showing a portable terminal and its operating environment in accordance with an embodiment of the present invention.

Description will now be given in detail to a portable terminal according to embodiments of the present invention, with reference to the accompanying drawings. FIG. 1 is a schematic view showing a portable terminal and its operating environment in accordance with an embodiment of the present invention. As shown in FIG. 1, a portable terminal 1 forms a wireless (radio) network together with another terminal 32 removed from the portable terminal 1, and a peripheral base station 31. Such a portable terminal 1 allows wireless audio/video or text communications with the another terminal 32.

In addition, the portable terminal 1 may be provided with a unit for wirelessly receiving radio broadcasts or TV broadcasts via broadcast signals such that an individual user can watch or listen to broadcast programs of the radio broadcasts or TV broadcasts at any particular place of the user.

An antenna for receiving the wireless communications or the broadcasts may be disposed inside the terminal 1 such that the antenna is not exposed to the outer appearance of the portable terminal (or externally). As a result, the portable terminal 1 can continuously have a simple outer appearance and yet, have an additional function, namely, a broadcast reception function, as well as wireless communications function.

The portable terminal may include a case 11 (also referred to as a casing, a housing, a cover or the like) forming the outer appearance thereof. Here, the terminal body may not be limited to a bar-type body illustrated in FIG. 1; however, it may be applicable to a slide type body, a folder type body or other types of bodies. The case 11 may be formed of an injection molded resin or formed of a metallic material, e.g., stainless steel (STS) or titanium (Ti).

A display 13, an audio output unit 12, a video input unit 14 and a first manipulation unit 17 may be disposed at a front surface of the case 11. Examples of the display 13 may include a liquid crystal display (LCD), an organic light emitting diode (OLED), an e-paper and the like, which can visually display information. The display 13 may further include a touch sensitive unit so that users can touch as the display 13 to input information, for example. The audio output unit 12 may be implemented as a receiver or a speaker.

The first manipulation unit (or user interface) 17 may be implemented as an exclusive input device that is separate from the display 13 having the touch sensitive unit. The first manipulation unit 17 may be configured as keys or buttons that are manipulated by push, or implemented to be touch-sensitive.

The video input unit 14 may be configured, for example, as a camera module which allows users to photograph (capture) images or generate video. Another video input unit may further be disposed at a rear surface of the portable terminal 1 such that users can capture an object facing an opposite direction from the video input unit 14. The audio input unit 18 may be implemented in a form of a microphone, for example, to receive a user's voice, other sounds, and the like.

A second manipulation unit 16 and an external interface 15 may be disposed at a side surface of the case 11. The first and second manipulation units 17 and 16 may be referred to as a manipulation portion, and any type of a manipulation unit may be adopted so long as it is manipulable by a user in a tactile manner. Examples of manipulation units may include a dome switch, a touch screen, or a touchpad that is configured to receive information or commands from a user by push or touch. Also, the manipulation unit 17 or 16 may be a wheel or a jog switch rotating keys, or a joy stick.

From a functional perspective, the first manipulation unit 17 may be configured to input commands such as START, END, SCROLL or the like, and the second manipulation unit 16 may function as a hot-key, which performs particular functions, such as adjusting a level (e.g., volume, brightness, search for menus, and the like), activating the video input unit 14, or the like.

The external interface 15 may serve to interface the portable terminal 1 with external devices for data exchange therebetween. For example, examples of such external devices may include at least one of a connection terminal to be connected to an earphone by wire or by radio, an Infrared Data Association (IrDA) port, a wireless LAN port, and so on. The external interface 15 may be configured as a card socket for accommodating a Subscriber Identification Module (SIM) card, a User Identity Module (UIM) card, or an external card such as a memory card for storing information.

Figure 2:
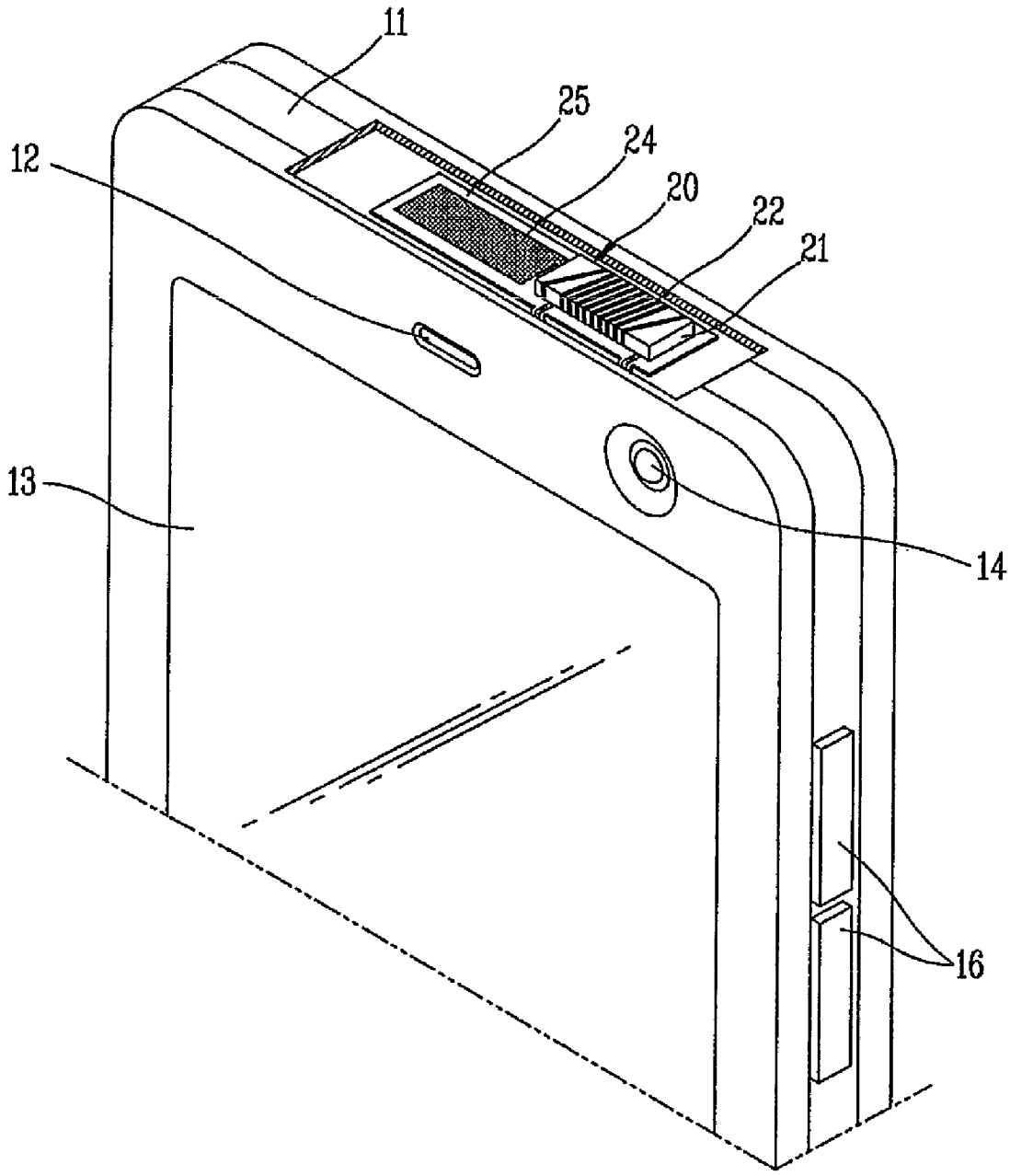
FIG. 2 is a partial perspective view of a portable terminal having a broadcast receiving antenna therein in accordance with an embodiment of the present invention.

FIG. 2 is a partial perspective view of a portable terminal having a broadcast receiving antenna therein in accordance with an embodiment of the present invention. As shown in FIG. 2, an antenna module 20 for receiving broadcast bands may be disposed inside the case 11. The antenna module 20 is formed to be considerably thin and small, so that the antenna module 20 occupies a relatively small space as compared to a size of the portable terminal 1. The antenna module 20 is disposed at an inner side of a side surface configured at an edge of the case 11, so as to minimize interfering with other components disposed in the case 11, and also to improve a radio functionality of the antenna module 20.

In the embodiment shown in FIG. 2, the antenna module 20 is positioned within a recess formed on the side surface of the portable terminal 1. In other embodiments, the antenna module 20 may be formed on any side of the portable terminal 1, be it the front side, the back side, or even the inside or the interior. The antenna module 20 need not be in a recessed portion of the portable terminal 1, but can also extend over one of the surfaces of the portable terminal 1. The antenna module 20 may even be retractable, may be positioned on a retractable portion of the portable terminal 1, or any portion that may be moved from a first position to a second position.

Additionally, in other embodiments, the antenna module 20 may be covered by a portion of the portable terminal 1, or may be positioned on a particular component of the portable terminal 1, such as a battery (power supply). If the antenna module 20 is formed on the battery, for example, when the battery is attached to the portable terminal 1, a connection can also be made from the antenna module 20 to the portable terminal 1 by either using a same connection or a different connection as that of the battery.

Figure 3:
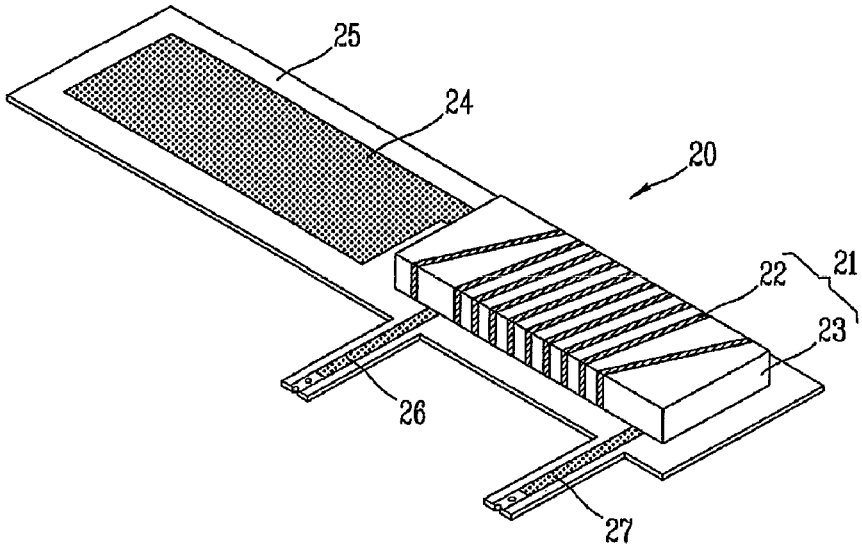
FIG. 3 is a perspective view showing an example broadcast receiving antenna in accordance with an embodiment of the present invention.

FIG. 3 is a perspective view showing an example broadcast receiving antenna module in accordance with an embodiment of the present invention. Referring to FIG. 3, the antenna module 20 is generally provided with a chip antenna 21, and a conductive plate 24 connected to the chip antenna 21.

The chip antenna 21 may include a dielectric chip 23 and a conductor 22. The conductor 22 may be patterned on the dielectric chip 23, so as to define a physical length of the chip antenna 21 that can operate within a broadcast band. The conductor 22 of the dielectric chip 23 may be helically wound on the dielectric chip 23, thereby effectively reducing the volume of the antenna module 20. The conductor 22 may be wound by winding a low temperature co-fired ceramic (LTCC) or coil, or winding a conductive strip with a preset width around the dielectric chip 23. Additional examples of the conductor 22 may include printing or masking the conductor 22 on the dielectric chip 23. in terms of configurations, the conductor 22 may be implemented in different patterns of a meander line, a patch, or an array, for example.

The dielectric chip 23 may have a relative permittivity ($\in_r$) equal to or greater than 1.0, and have a relative permeability ($\mu_r$) equal to or greater than 1.0. The dielectric chip 23 with the relative permittivity ($\in_r$) equal to or greater than 1.0 permittivity is characterized to move a resonance band downward. Thus, as compared to not using the dielectric chip 23, a physical length and/or a volume of the antenna 20 required for its operation is reduced. On the other hand, since the chip antenna 21 uses a broadcast band which needs a relatively long resonance wavelength (e.g., a frequency modulation (FM) frequency band is 88~108 MHz), it may be difficult to obtain sufficient radio sensitivity (radio reception quality, radio performance, etc.) by use of only the size-reduced chip antenna 21. Accordingly, the conductive plate 24 is further connected to the chip antenna 21 to induce a main radiation within a broadcast band therein. The conductive plate 24 may be formed of a metallic material with a preset area. The conductive plate 24 may be integrally attached to the chip antenna 21 so as to implement as an integrated body. As shown in FIG. 3, the chip antenna 21 and the conductive plate 24 may be formed side-by-side, or collinearly. In other embodiments, the chip antenna 21 and the conductive plate 24 may be formed stacked, parallel, perpendicular or any other configuration.

In addition, the conductive plate 24 and the chip antenna 21 may be fabricated to form one body by a single process to allow easy handling of the antenna module and to improve assembly of the portable terminal 1. Also, the conductive plate may be coated with a dielectric film.

Referring to FIG. 3, the conductive plate 24 may be configured in a form of a flexible plate by employing a dielectric seat 25. The conductive plate 24 with flexibility can reduce or prevent an increase in a thickness of the antenna module 20 such that the antenna module 20 can flexibly engage a particular space within the case 11.

Among others, the conductive plate 24 may be formed of stainless steel (STS), a copper foil, a decorative metal disposed outside or at a middle of the case 11, or the like. Alternatively, the conductive plate 24 may be formed by coating a conductive paint within a preset area of the case 11.

As such, the dielectric chip 23 with the noted permittivity and permeability can effectively reduce a physical length of the antenna module 20 to be as short as possible, which allows the antenna module 20 to be smaller in size. Also, the dielectric chip 23 leads a main radiation of the broadcast band (signal) on the conductive plate 24 so as to increase radio reception quality.

Feeding portions 26 and 27 of the antenna module 20 may be positioned at a side of the chip antenna 21. FIG. 3 shows that the feeding portions 26 and 27 includes a signal feeding portion 26 connected to the conductor 22 of the dielectric chip 23, and a ground feeding portion 27 connected to a ground within the case 11 and electromagnetically coupled to the conductor 22 of the dielectric chip 23. In another embodiment, the antenna module 20 may be configured as a monopole antenna without the ground feeding portion 27.

FIG. 3 further depicts that the feeding portions 26 and 27 are formed in a form of a land so as to be connected by soldering. Alternatively, each of the feeding portions 26 and 27 may be implemented as a leaf spring, a finger or C-clip, or be implemented as a pad to be contactable with a target object configured as a spring.

Figure 4:
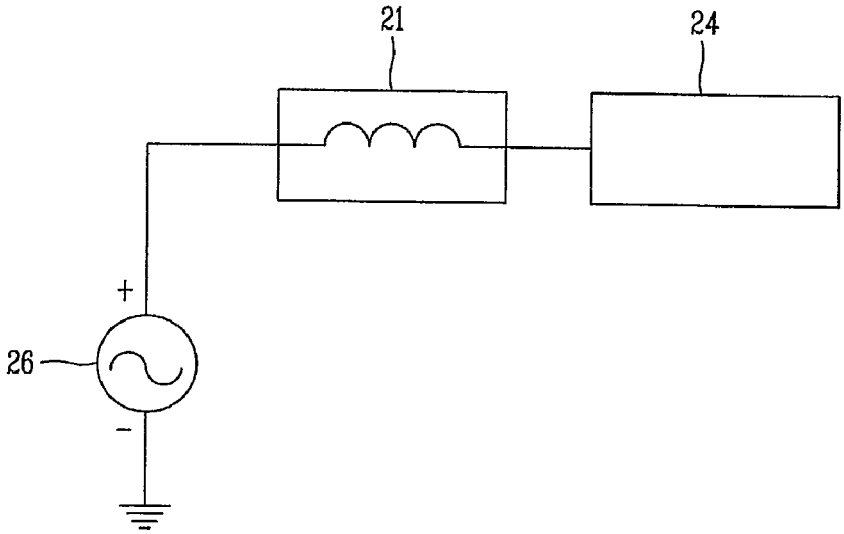
FIGS. 4 to 6 are circuit views of broadcast receiving antennas in accordance with embodiments of the present invention.
Figure 5:
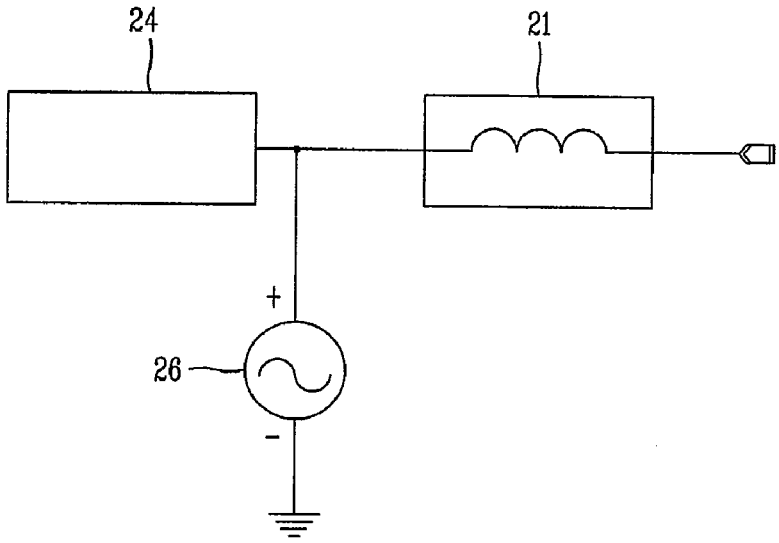
Figure 6:
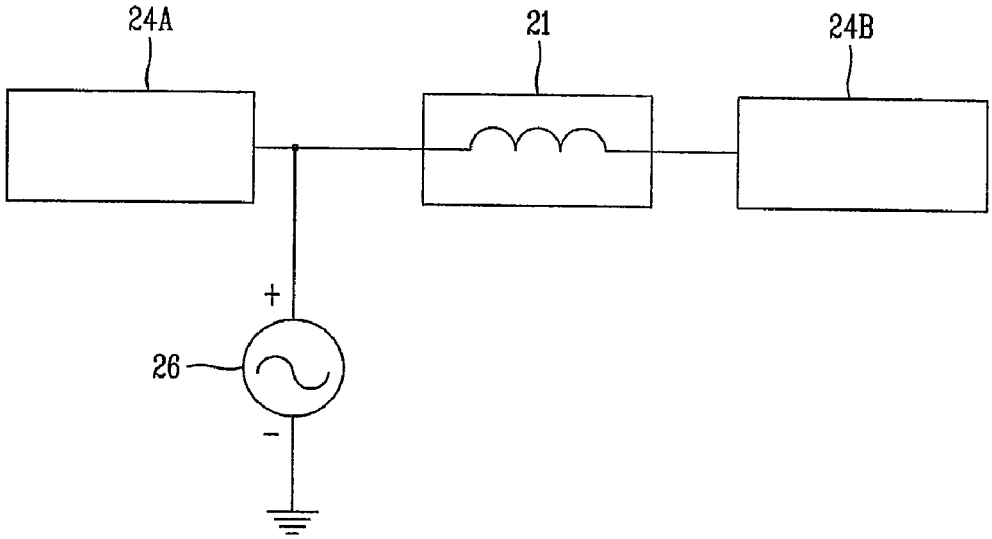

FIGS. 4 to 6 are circuit views of broadcast receiving antennas in accordance with embodiments of the present invention. FIG. 4 shows that the conductive plate 24 may be configured as a radiator of an output end of the chip antenna 21, and FIG. 5 shows that the conductive plate 24 may be configured as a radiator of an input end of the chip antenna 21. The chip antenna 21 may define a physical length and a resonance band of the antenna module 20. Because the chip antenna 21 is small in size, it may not have sensitivity high enough to operate as a broadcast receiving antenna. Hence, the conductive plate 24 may additionally be connected to the input end or output end of the chip antenna 21.

FIG. 6 shows that a conductive plate 24A and a conductive plate 24B may be respectively connected to the input end and output end of the chip antenna 21 so as to be configured as radiators. In this case, the overall reception performance (reception quality) of the antenna module will be more improved.

Hereinafter, the performance of the antenna module will be described with reference to Table 1 as follows.

TABLE 1

| | comparison | Embodiment 1 | | | | | | Embodiment 2 | | | |
|---|---|---|---|---|---|---|---|---|---|---|---|
| | | Initial state | | Matching state | | Chip Antenna + Radiator | | Matching State | | Chip Antenna + Radiator | |
| Ch. (MHz) | Open Field (dBm) | In Lab (dBm) | Open Field (dBm) | In Lab (dBm) | Open Field (dBm) | In Lab (dBm) | Open Field (dBm) | In Lab (dBm) | Open Field (dBm) | In Lab (dBm) | Open Field (dBm) |
| 89.1 | 36 | 5 | 13 | 8 | 20 | 9 | 24 | 3 | 12 | 11 | 25 |
| 89.7 | 33 | 4 | 14 | 11 | 19 | 11 | 27 | 6 | 24 | 9 | 25 |
| 91.9 | 34 | 0 | 20 | 6 | 12 | 6 | 26 | 0 | 13 | 12 | 16 |
| 93.1 | 39 | 0 | 25 | 18 | 23 | 22 | 36 | 3 | 32 | 10 | 31 |
| 93.9 | 51 | 7 | 29 | 12 | 35 | 22 | 42 | 6 | 31 | 7 | 41 |
| 95.1 | 34 | 0 | 16 | 2 | 12 | 3 | 30 | 3 | 24 | 8 | 29 |
| 95.9 | 53 | 4 | 23 | 17 | 34 | 25 | 41 | 14 | 31 | 18 | 42 |
| 97.3 | 52 | 5 | 27 | 21 | 37 | 22 | 42 | 12 | 36 | 17 | 43 |
| 98.1 | 54 | 8 | 32 | 22 | 35 | 26 | 42 | 6 | 39 | 10 | 46 |
| 99.1 | | 0 | 3 | 5 | 7 | 0 | 16 | 0 | 10 | 2 | 16 |
| 99.9 | | 0 | 22 | 2 | 6 | 3 | 26 | 0 | 17 | 5 | 20 |
| 101.9 | | 1 | 23 | 17 | 26 | 21 | 32 | 6 | 36 | 10 | 39 |
| 103.5 | | 3 | 32 | 20 | 38 | 23 | 44 | 14 | 42 | 7 | 50 |
| 104.5 | | 0 | 30 | 18 | 35 | 18 | 39 | 8 | 38 | 17 | 46 |
| 105.3 | | 0 | 23 | 13 | 27 | 8 | 33 | 14 | 33 | 18 | 39 |
| 106.2 | | 4 | 31 | 17 | 38 | 20 | 41 | 13 | 37 | 24 | 50 |
| 106.9 | | 0 | 29 | 15 | 34 | 14 | 39 | 16 | 32 | 22 | 47 |
| 107.7 | | 2 | 28 | 11 | 32 | 15 | 38 | 15 | 41 | 10 | 46 |

In Table 1, Comparison depicts a case of using an earphone cable as an antenna, Embodiment 1 depicts a case where the chip antenna 21 has a size of 25(width)×5(length)×2(height) (unit: mm), and Embodiment 2 depicts a case where the chip antenna 21 has a size of 12(width)×5(length)×2(height) (unit: mm).

As shown in Table 1, it can be noticed that, for the Comparison embodied to use an earphone cable as an antenna, the earphone cable is exposed to the outside and can have a length long enough to obtain a relatively excellent reception quality. However, the earphone cable would be inconveniently connected whenever receiving broadcasts, and that such earphone cable is not used when watching or listening to broadcasts via a loud speaker. So, in embodiments of the present invention, without using the earphone cable, an internal broadcast receiving antenna 20 having a similar performance to that of the earphone cable is used, to thereby enable the use of the broadcast receiving antenna even in an intermediate/weak electric field (or broadcast signal).

It can be seen in Table 1 that the reception quality is rarely ensured in the noted Initial state that only use the chip antenna 21 alone, which indicates that the chip antenna 21 allows the antenna module 20 to have a physical length that is usable, but the chip antenna 21 does not support sufficient radio reception quality.

Upon coupling (connecting) the chip antenna 21 to a matching element (i.e., in the noted Matching state), it can be noticed from Table I that the overall performance of the antenna module 20 is improved. However, for the Matching state, there is an increase in the number of matching elements which also makes a fabricating procedure of the portable terminal more complicated.

In case of connecting a conductive plate 24 (i.e., radiator) to the chip antenna 21 for use, it can be seen from Table 1 that the antenna module 20 can obtain better radio reception quality than even the case of the Matching states of Embodiments 1 and 2.

Accordingly, it can be understood that the antenna-module 20 having the chip antenna 21 and the conductive plate 24 coupled to each other can reduce the need to have other matching components or devices, so as to make fabrication simple, and can effectively replace a large antenna (i.e., antenna in Comparison) that would be externally exposed.

Figure 7:
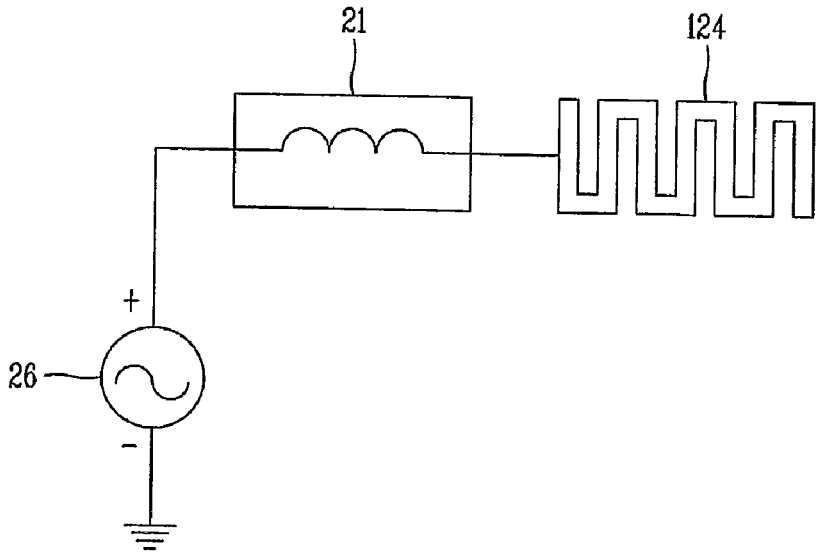
FIGS. 7 to 10 are conceptual views showing variations of a conductive plate in accordance with embodiments of the present invention.

FIGS. 7 to 10 are conceptual views showing variations of a conductive plate in accordance with embodiments of the present invention. In order to provide better radio performance, such as better reception, the conductive plate 24 can be patterned and can also be tuned. As shown in FIG. 7, a conductive plate 124 may has a meander pattern. Even if the meander pattern is configured to attenuate currents, the meander pattern can increase an area of the conductive plate 124 so as to lead a better radiation. Thus, the meander pattern may be effectively used.

Figure 8:
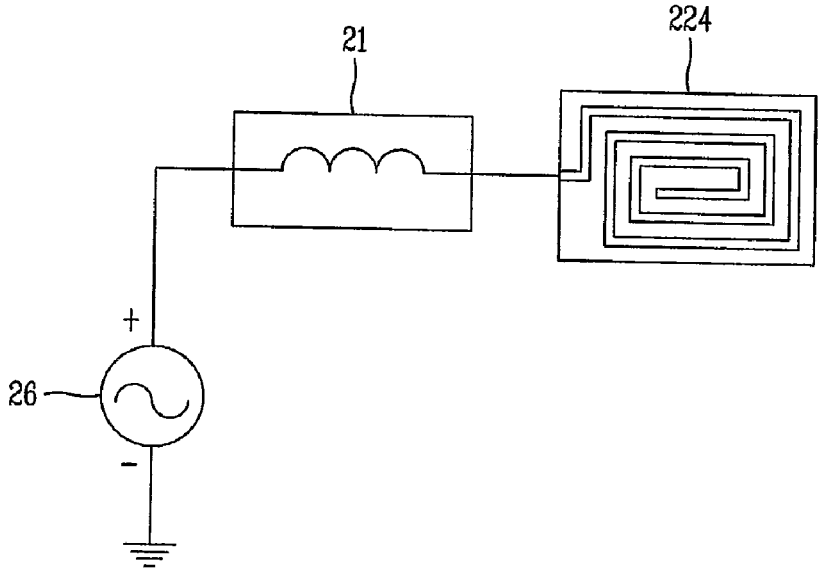
Figure 9:
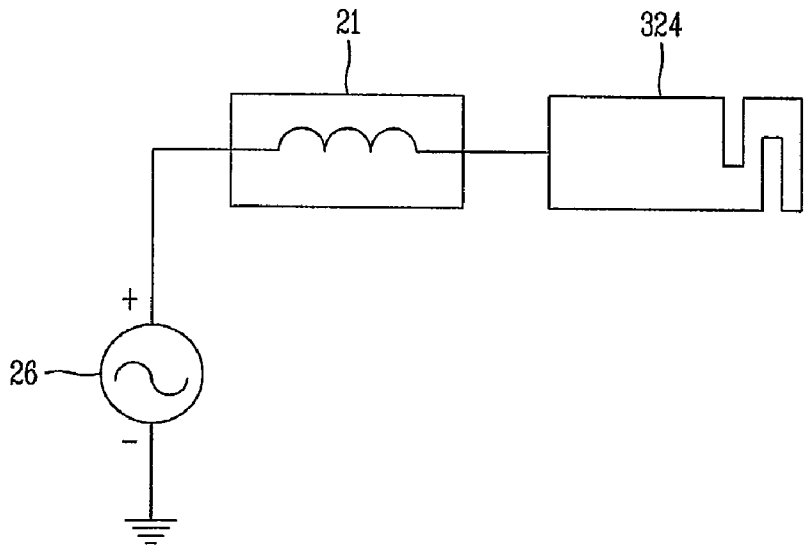

FIG. 8 shows an embodiment of a conductive plate 224 in a spiral pattern. The spiral pattern has great inductance. However, it does not attenuate currents and thus, provides better efficiency than the meander pattern. FIG. 9 shows an embodiment of a conductive plate 324 is configured to have only a partial meander pattern so as to increase a radiation area.

Figure 10:
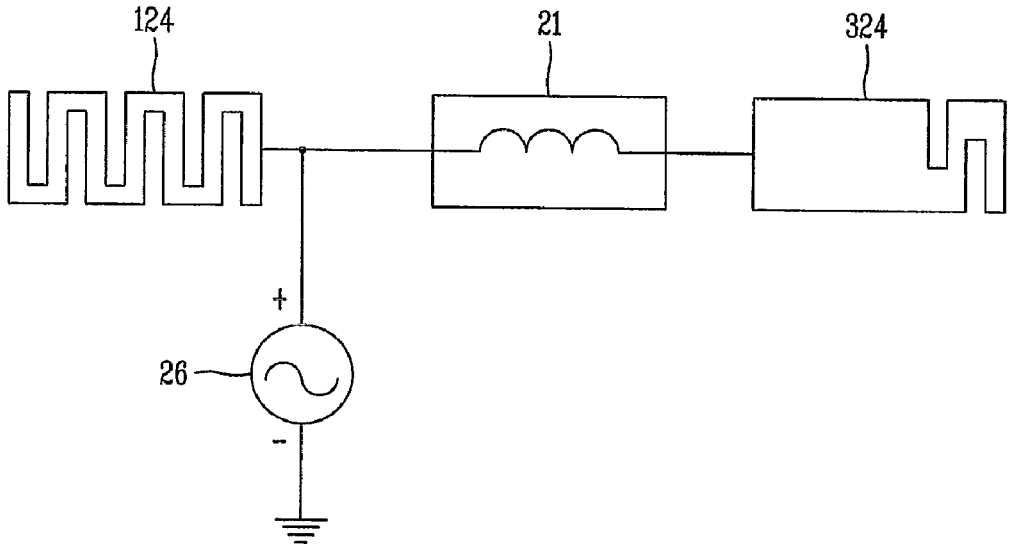
Figure 11:
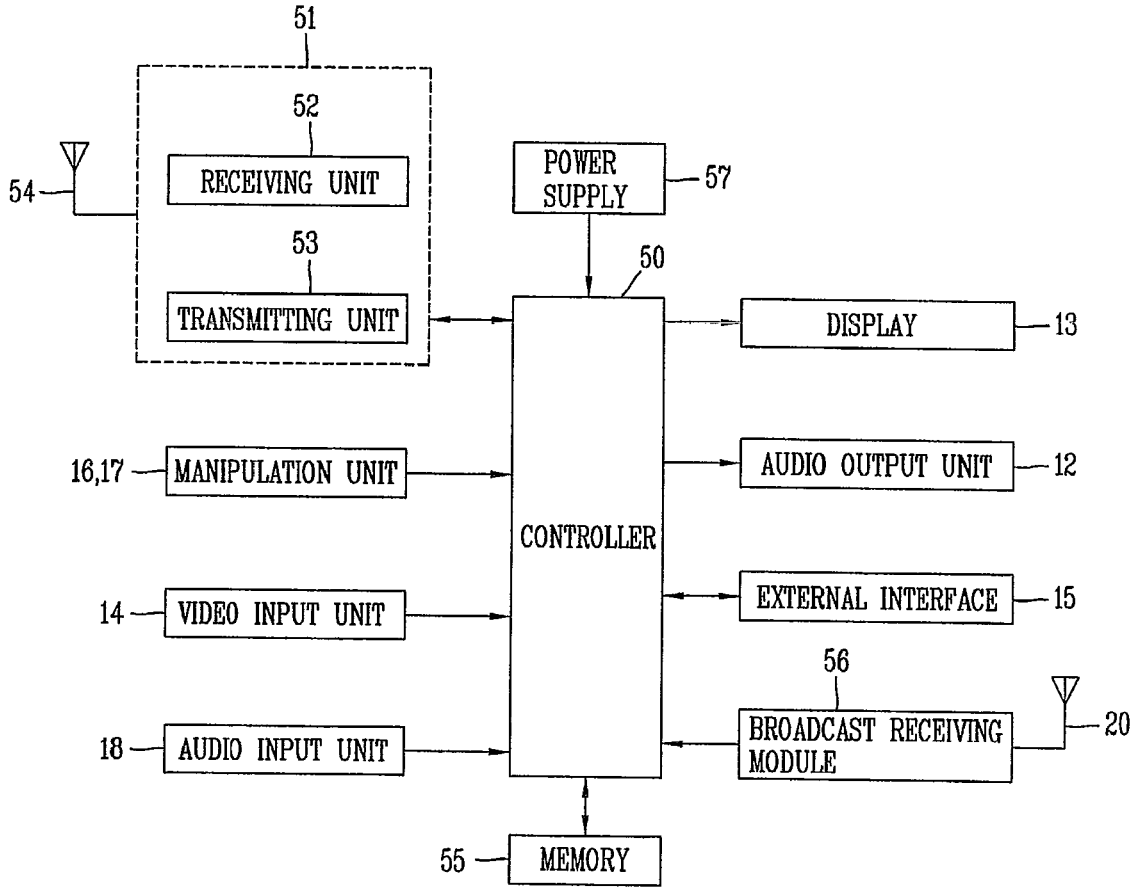
FIG. 11 is a block diagram of a portable terminal in accordance with an embodiment of the present invention.

FIG. 10 shows an embodiment provided with a plurality of conductive plates 124 and 324, each of which has a different pattern. FIG. 11 is a block diagram of a portable terminal in accordance with an embodiment of the present invention.

As shown in FIG. 11, a portable terminal according to an embodiment of the present invention may include a wireless communication module 51, manipulation unit(s) 16 and 17, a video input unit 14, an audio input unit 18, a display 13, an audio output unit 12, an external interface 15, a broadcast receiving module 56, a memory 55, a power supply 57 and a controller 50. The controller 50 typically performs a control of an overall operation of the portable terminal. For example, the controller 50 may perform the control and processing for voice communications, data communications, telephony calls and the like.

The wireless communication module 51 may communicate by radio signals with an external base station via an antenna 54 disposed for mobile communications. The wireless communication module 51 manages transmission and reception of audio data, text (message) data, video data and control data under the control of the controller 50. To this end, the wireless communication module 51 includes a transmitting unit 53 for modulating a signal to be sent for transmission, and a receiving unit 52 for demodulating the received signal.

The manipulation unit(s) 16 and 17 may be configured as shown in FIG. 1 and provide the controller 50 with data related to a key input manipulated by a user for controlling an operation of the portable terminal. The manipulation units 16 and 17 may be implemented as a dome switch, a touchpad (e.g., static pressure/capacitance), a jog wheel, a jog switch and the like.

The video input unit 14 receives and processes image frames of still image or video obtained by image sensors in a video call mode or a capturing mode. The processed image frames are converted into video data displayable on the display 13 so as to be output to the display 13. The image frames processed by the video input unit 14 may be stored in the memory 55 or sent to the exterior via the wireless communication module 51 under the control of the controller 50.

The audio input unit 18 may receive an external audio signal via a microphone while the portable terminal is in a particular mode, such as a phone call mode, a recording mode, a voice recognition mode, or the like. This audio signal is processed into digital data. The processed digital data is converted for output into a format transmittable to a mobile communication base station via the wireless communication module 51 in case of the phone call mode. The processed audio data is stored in the memory 55 in case of the recording mode. The audio input unit 18 may include assorted noise removing algorithms to remove noise generated in the course of receiving the external audio signal.

The display 13 may output information processed in the portable terminal. For example, when the portable terminal is operating in a phone call mode, the display 13 will provide a User Interface (UI) or a Graphic User Interface (GUI) which includes information associated with the phone call. As another example, if the portable terminal is in a video call mode or a capturing mode, the display 13 may additionally or alternatively display images captured and/or received, UI, or GUI under the control of the controller 50. When being configured with a touch screen, the display 13 may be used as both the output device and an input device.

The audio output unit 12 may convert audio data received from the wireless communication module 51 or audio data stored in the memory 55, under the control of the controller 50, so as to output to the exterior, in a particular mode, such as a call-receiving mode, a call-placing mode, a recording mode, a voice recognition mode, a broadcast reception mode, and so on. The audio output unit 12 may also output audio signals associated with functions (e.g., a call reception sound, a message reception sound, and the like) performed in the portable terminal. Such audio output unit 12 may include a speaker, a receiver, a buzzer, and the like.

The external interface 15 may be implemented to interface the portable terminal with every external device, including wired/wireless headsets, external chargers, wired/wireless data ports, card sockets (e.g., memory card, SIM/UIM card and the like) and the like. The external interface 15 may allow a data reception from an external device, a power delivery to each component in the portable terminal, or a data transmission from the portable terminal to an external device.

The memory 55 may store a program for the processing and control of the controller 50. Alternatively, the memory 55 may temporarily store input/output data (e.g., phonebook data, messages, still images, video and the like). The memory 55 may be implemented using any type of suitable storage medium including a hard disk type, a memory card type (e.g., SD or DX memory), a flash memory type, Random Access Memory (RAM), Read-Only Memory (ROM), and the like.

The broadcast receiving module 56 may receive broadcast signals via the antenna module 20 disclosed in FIGS. 2 to 10 and converts the broadcast signals received into a format of broadcast data displayable on the display 13, thus to output to the controller 50. Also, the broadcast receiving module 56 may receive additional data (e.g., electric program guide, channel list, and the like) associated with broadcasts. The broadcast data and the additional data converted by the broadcast receiving module 56 may be stored in the memory 55.

The power supply 57 provides power required for operations of each of various components under the control of the controller 50. The provided power may be internal power, external power, or combination thereof.

In the above configured portable terminal according to an embodiment of the present invention, the broadcast receiving module 56 includes the chip antenna and the conductive plate, so that a physical length of the broadcast receiving antenna can be reduced as short as possible by employing the chip antenna. Accordingly, making the antenna module and the portable terminal become smaller in size is facilitated. Also, the chip antenna and the conductive plate are configured to lead a main radiation on the conductive plate, thereby increasing radio reception quality and improving radio performance. In addition, the configuration of the chip antenna and the conductive plate can reduce an area required for shielding the chip antenna so as to decrease an interference with other components disposed in the portable terminal, and decrease the limitation on arrangement of the other components in the portable terminal. In addition, the conductive plate can be employed to increase the radio sensitivity such that the portable terminal can be ensured of clear reception quality without disconnection or noise even in zones of intermediate or weak electric fields.

The foregoing embodiments and advantages are merely exemplary and are not to be construed as limiting the present disclosure. The present teachings can be readily applied to other types of apparatuses. This description is intended to be illustrative, and to not limit the scope of the claims. Many alternatives, modifications, and variations will be apparent to those skilled in the art. The features, structures, methods, and other characteristics of the example embodiments described herein may be combined in various ways to obtain additional and/or alternative example embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A portable terminal, comprising:

a terminal case; and an antenna module installed in the terminal case, and configured to receive a broadcast band, wherein the antenna module includes:

a chip antenna having a dielectric chip and a conductor, the conductor being patterned on the dielectric chip so as to define a physical length of the chip antenna that enables the chip antenna to operate within the broadcast band, and a conductive plate connected to the chip antenna, and configured to have an area on which a main radiation of the antenna module occurs, wherein the conductive plate includes first and second conductive plates, wherein the first conductive plate is configured as a meander pattern and electronically connected to a side of the chip antenna, wherein the second conductive plate is configured as a partial meander pattern and electronically connected to an opposite side of the chip antenna, and wherein at least one of feeding portions of the antenna module is disposed at a connecting line between the first conductive plate and the chip antenna.

2. The portable terminal of claim 1, wherein the conductor of the chip antenna is helically wound on the dielectric chip.

3. The portable terminal of claim 1, wherein the conductive plate is integrally formed with the chip antenna to form one body.

4. The portable terminal of claim 3, wherein the conductive plate is flexible.

5. The portable terminal of claim 1, wherein the first and second conductive plates are respectively formed in different patterns.

6. The portable terminal of claim 1, wherein the terminal case has a side surface on an edge portion thereof, and the antenna is disposed inside a recess in the side surface of the terminal case.

7. The portable terminal of claim 1, wherein the dielectric chip has a relative permittivity equal to or greater than 1.0.

8. The portable terminal of claim 1, wherein the dielectric chip has a relative permeability equal to or greater than 1.0.

9. The portable terminal of claim 1, wherein the broadcast band is implemented as a frequency modulation (FM) band or a digital broadcast band.

10. The portable terminal of claim 1, wherein the feeding portions of the antenna module are disposed at the chip antenna.

11. The portable terminal of claim 10, wherein the feeding portions comprise:

a signal feeding portion connected to the conductor of the chip antenna; and a ground feeding portion connected to a ground of the portable terminal, and electromagnetically coupled to the conductor of the chip antenna.

12. The portable terminal of claim 1, wherein the conductive plate is coated with a dielectric film.

13. An antenna module of a portable terminal for receiving a broadcast band, comprising:

a chip antenna having a dielectric chip and a conductor, wherein the conductor is patterned on the dielectric chip so as to define a physical length of the chip antenna that enables the chip antenna to operate within the broadcast band; and a conductive plate connected to the chip antenna, and configured to have an area such that the conductive plate leads a main radiation of the antenna module, wherein the conductive plate includes a plurality of the conductive plates, wherein a first conductive plate of the plurality of conductive plates is configured as a pattern and electronically connected to a side of the chip antenna, wherein a second conductive plate of the plurality of conductive plates is configured as a different pattern and electronically connected to an opposite side of the chip antenna, and wherein at least one of feeding portions is disposed at a connecting line between the first conductive plate and the chip antenna.

14. The antenna module of claim 13, wherein the conductor of the chip antenna is helically wound on the dielectric chip.

15. An antenna module for receiving a broadcast band, the antenna module including:

a chip antenna having a dielectric chip and a conductor, the conductor being formed over the dielectric chip and defining a length of the chip antenna to operate within the broadcast band; and a conductive plate connected to the chip antenna and positioned at a side thereof, and configured to have an area that induces a main radiation of the broadcast band, the conductive plate having a first conductive plate and a second conductive plate, wherein feeding portions of the antenna module are disposed at the chip antenna, and the feeding portions comprise:

a signal feeding portion connected to the conductor of the chip antenna; and a ground feeding portion connected to a ground of the portable terminal, and electromagnetically coupled to the conductor of the chip antenna, wherein the first conductive plate is configured as a pattern and electronically connected to a side of the chip antenna, wherein the second conductive plate is configured as a different pattern and electronically connected to an opposite side of the chip antenna, and wherein at least one of the feeding portions of the antenna module is disposed at a connecting line between the first conductive plate and the chip antenna.

16. The antenna module of claim 15, wherein the conductor of the chip antenna is helically wound on the dielectric chip, and the conductive plate has any one of a meander line pattern, a spiral pattern, and a combined pattern of the meander line pattern and the spiral pattern.

17. A portable terminal, comprising:

a terminal case; and the antenna module of claim 15, the antenna module being attached to the terminal case, in a recessed portion thereof.

* * * * *